United States Patent [19]

Mellor

[11] 4,190,006

[45] Feb. 26, 1980

[54] TUFTING MACHINES

[75] Inventor: Leslie Mellor, Blackburn, England

[73] Assignee: Edgar Pickering (Blackburn) Limited, Lancashire, England

[21] Appl. No.: 922,100

[22] Filed: Jul. 5, 1978

[30] Foreign Application Priority Data

Aug. 5, 1977 [GB] United Kingdom ..... 33009/77

[51] Int. Cl.[2] ..... D05C 15/00

[52] U.S. Cl. ..... 112/79 R; 112/221

[58] Field of Search ..... 112/79 R, 221

[56] References Cited

U.S. PATENT DOCUMENTS

| | | | |
|---|---|---|---|
| 3,286,670 | 11/1966 | Boyles | 112/221 R X |
| 3,653,346 | 4/1972 | Parsons | 112/79 R |
| 3,665,873 | 5/1972 | Wittler | 112/221 X |
| 3,830,174 | 8/1974 | Mezlor | 112/79 R |
| 3,857,345 | 12/1974 | Higgins | 112/79 R |

*Primary Examiner*—Ronald Feldbaum

*Attorney, Agent, or Firm*—Watson, Cole, Grindle & Watson

[57] ABSTRACT

A tufting machine which includes mechanism for adjusting the stroke of the needles which is operable from the exterior of the machine and such that the bottom dead center position of the needles remains at a constant level in all positions of adjustment.

2 Claims, 4 Drawing Figures

TUFTING MACHINES

When it is required to adjust a tufting machine to alter the height of the pile to be produced by the machine it is necessary, among other adjustments, for example in the rate of yarn feed and in the level of the bedplate which supports the backing fabric, to alter the stroke of the needles. This has hitherto been a major operation which has involved stopping the machine, obtaining access to the interior of the machine and making various adjustments including, assuming the length of the needles is to remain unchanged, a difficult and complicated adjustment, to ensure that the bottom dead centre position of the needles will be at the same level as before. This is necessary to ensure proper picking up of the loops of yarn from the needles by the loopers.

The object of the invention is to provide a tufting machine which includes mechanism for adjusting the stroke of the needles which is operable from the exterior of the machine, if desired while the machine is running, and such that the bottom dead centre position of the needles remains at a constant level in all positions of adjustment of said mechanism.

The tufting machine according to the invention comprises a vertically reciprocable needle bar, push rods for imparting movement to the needle bar, a main shaft disposed parallel to the needle bar, and a linkage between the main shaft and each push rod, comprising a screw, an eccentric on the main shaft, a main link embracing the eccentric, another link connecting the main link to the push rod, a control link pivoted at one end to the main link and at the other end to a nut on the screw, a control yoke, of the same length as the control link, which is pivoted at one end to the nut coaxially with the control link and at the other end on a fixed pivot, the pivotal axes of the ends of the control link and the control yoke remote from the nut being coincident in the bottom dead centre position of the needle bar, and adjusting means accessible from the exterior of the machine for rotating all the screws to adjust the positions of the nuts thereon.

Figure 1:
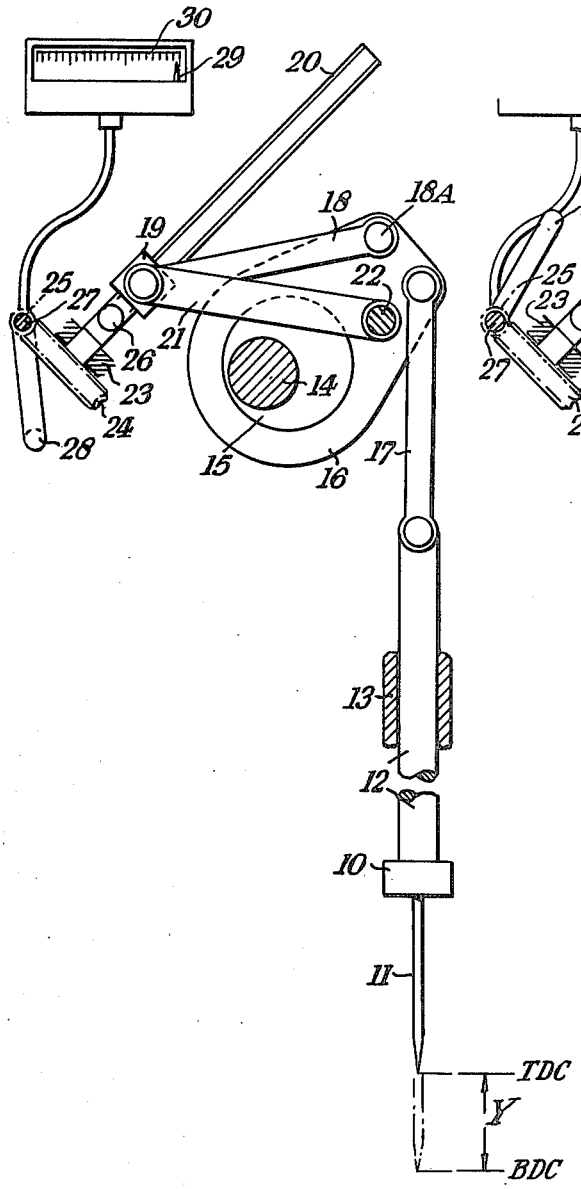
Figure 2:
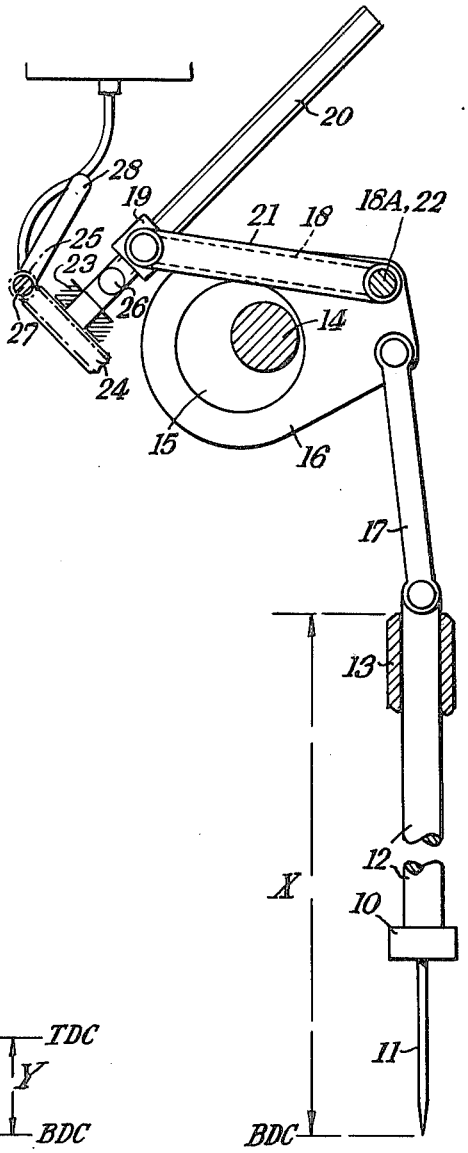
Figure 3:
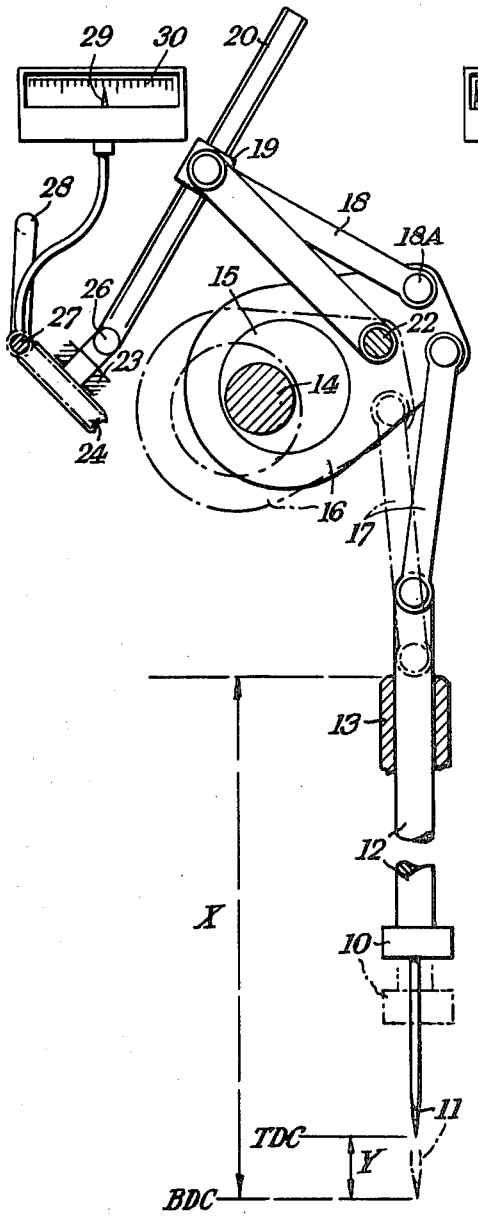
Figure 4:
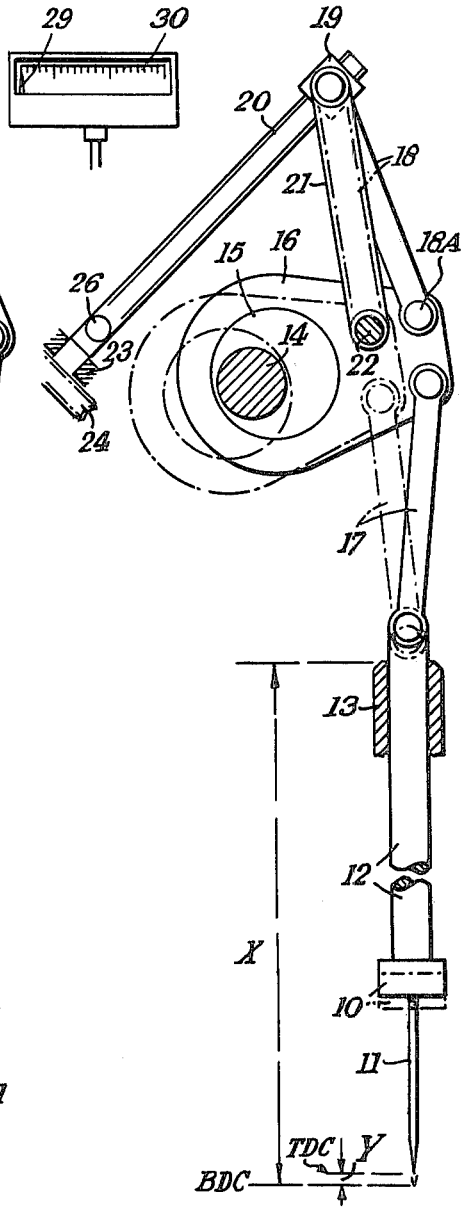

One embodiment of the invention is illustrated in the accompanying diagrammatic drawings, in which:

FIGS. 1 and 2 show the mechanism adjusted for maximum stroke of the needles, with the parts in positions corresponding respectively to the top and bottom of the stroke, FIG. 3 shows the mechanism adjusted for an intermediate stroke of the needles, and FIG. 4 shows the mechanism adjusted for minimum stroke of the needles.

A needle bar 10, which carries a row of needles 11 extending transversely to the direction of travel of fabric to be tufted, carries at intervals in conventional fashion push rods 12, each of which is guided for vertical movement in a fixed housing 13. Vertical reciprocating movement is imparted to each of the push rods 12 from a main shaft 14 disposed above the needle bar 10 by the linkage illustrated in the drawings.

The linkage consists of an eccentric 15 on the shaft 14, a main link 16 embracing the eccentric, a push rod link 17 connected between the main link 16 and the push rod 12, a control link 18 pivoted at one end 18A to the main link 16 and at the other end to a swivel nut 19 on a control screw 20, and a control yoke 21 of the same length as the control link 18. The yoke 21 is pivoted at one end to the nut 19 coaxially with the corresponding end of the control link 18 and at the other end on a fixed pivotal axis 22.

The screw 20 is mounted for rotation in a fixed bearing 23 and carries a worm wheel 24, which meshes with a worm 25 on a cross shaft 27 which extends for the full width of the machine. The cross shaft 27 carries at one end an operating lever 28 external to the machine, which is operable to rotate the cross shaft 27 and therefore all the screws 20 to adjust the positions of the nuts 19 thereon. The cross shaft 27 is connected to an external pointer 29 which cooperates with a scale 30 calibrated to show the stroke of the needles. The screw 20 includes a universal joint 26 which allows the screw to move in response to the arcuate movement of the nut 19 as the control yoke 21 moves around the fixed centre 22 between its extreme positions during adjustment.

When the nut 19 is at the end of the screw 20 remote from the worm wheel 24, as shown in FIG. 4, the stroke Y of the needles, i.e. the distance between top dead centre TDC and bottom dead centre BDC, is set to the minimum. When the nut 19 is at the other end of the screw 20, as shown in FIGS. 1 and 2, the stroke Y of the needles is a maximum. In both cases the centres 18A and 22 are coincident at bottom dead centre so that the bottom dead centre position of the needles is unaffected by the stroke adjustment. The dimension X, between the top of the housing 13 and BDC, accordingly remains constant.

In the case illustrated, the throw of the eccentric 15 is $\frac{3}{4}''$, the minimum stroke of the needles is $\frac{3}{8}''$ and the maximum stroke of the needles is 2 15/16".

The worm 25 and worm wheel 24 and the screw threaded connection between the screw 20 and the nut 19 lock the mechanism against movement from the adjusted position. The linkage operates at maximum advantage at the bottom end of the stroke when the needles are piercing the fabric.

The main shaft 14 may carry at its ends similar adjustable linkages to that illustrated for varying the rocking movement of the loopers and also, in the case of a machine for making cut pile fabric, similar linkages for adjusting the stroke of the knives.

What I claim as my invention and desire to secure by Letters Patent is :

1. A tufting machine comprising a vertically reciprocable needle bar, push rods for imparting movement to the needle bar, a main shaft disposed parallel to the needle bar, and a linkage between the main shaft and each push rod, comprising a screw, an eccentric on the main shaft, a main link embracing the eccentric, another link connecting the main link to the push rod, a control link pivoted at one end to the main link and at the other end to a nut on the screw, a control yoke, of the same length as the control link, which is pivoted at one end to the nut coaxially with the control link and at the other end on a fixed pivot, the pivotal axes of the ends of the control link and the control yoke remote from the nut being coincident in the bottom dead centre position of the needle bar, and adjusting means accessible from the exterior of the machine for rotating all the screws to adjust the positions of the nuts thereon.

2. A tufting machine according to claim 1, wherein the adjusting means comprises a cross shaft which extends for the full width of the machine and carries worms meshing with worm wheels on the screws.

* * * * *